US009726377B2

(12) United States Patent
Ciani et al.

(10) Patent No.: US 9,726,377 B2
(45) Date of Patent: Aug. 8, 2017

(54) BURNER OF A GAS TURBINE

(75) Inventors: Andrea Ciani, Zurich (CH); Johannes Buss, Hohberg (DE)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 1286 days.

(21) Appl. No.: 12/720,192

(22) Filed: Mar. 9, 2010

(65) Prior Publication Data

US 2010/0287940 A1 Nov. 18, 2010

(30) Foreign Application Priority Data

May 14, 2009 (EP) ..... 09160209

(51) Int. Cl.
*F23R 3/12* (2006.01)
*F23R 3/28* (2006.01)

(52) U.S. Cl.
CPC ..... *F23R 3/12* (2013.01); *F23R 3/286* (2013.01); *F23D 2900/14021* (2013.01); *F23R 2900/03341* (2013.01)

(58) Field of Classification Search
CPC .. F23R 3/28; F23R 3/283; F23R 3/286; F23R 3/30; F23R 3/32; F23R 3/34; F23R 3/343; F23R 3/44; F23R 3/10; F23R 3/12; F23R 3/14; F23R 3/20; F23D 2900/14021
USPC ..... 60/737, 738, 746, 747, 748, 752, 804
See application file for complete search history.

(56) References Cited

U.S. PATENT DOCUMENTS 3,722,484 A * 3/1973 Gordini ..... F01L 1/262 123/90.27
4,713,938 A * 12/1987 Willis ..... 60/742
5,193,346 A * 3/1993 Kuwata et al. ..... 60/737
5,477,685 A * 12/1995 Samuelson et al. ..... 60/737
5,603,212 A * 2/1997 Schulte-Werning ..... 60/39.17
5,609,030 A * 3/1997 Althaus ..... 60/737
5,626,017 A * 5/1997 Sattelmayer ..... 60/723
5,658,358 A * 8/1997 Chyou et al. ..... 48/180.1
6,334,309 B1 * 1/2002 Dean et al. ..... 60/737
6,337,873 B1 * 1/2002 Goering ..... G02B 27/09 359/618
6,702,574 B1 * 3/2004 Dobbeling ..... F23C 7/002 239/403
7,007,477 B2 * 3/2006 Widener ..... 60/737
7,412,833 B2 * 8/2008 Widener ..... 60/772
7,581,402 B2 * 9/2009 Parker ..... 60/798
8,136,359 B2 * 3/2012 Stuttaford et al. ..... 60/742
8,607,569 B2 * 12/2013 Helmick et al. ..... 60/737

(Continued)

FOREIGN PATENT DOCUMENTS

CA 2164482 A1 * 6/1996 ..... F23C 6/047
EP 0619456 10/1994

(Continued)

OTHER PUBLICATIONS

European Search Report for EP Patent App. No. 09160209.4 (Nov. 6, 2009).

*Primary Examiner* — Pascal M Bui Pho
*Assistant Examiner* — Marc Amar
(74) *Attorney, Agent, or Firm* — Buchanan Ingersoll & Rooney PC

(57) ABSTRACT

The burner (1) of a gas turbine includes a duct (2) which houses four vortex generators (3) and a lance (7) that carries one or more nozzles (8) for injecting a fuel within the duct (2). The lance (7) extends from one of the vortex generators (3).

19 Claims, 3 Drawing Sheets

(56) References Cited

U.S. PATENT DOCUMENTS

| | | | | |
|---|---|---|---|---|
| 2005/0223709 | A1* | 10/2005 | Bleeker | 60/737 |
| 2005/0235647 | A1* | 10/2005 | Boston et al. | 60/740 |
| 2007/0000228 | A1* | 1/2007 | Ohri et al. | 60/39.37 |
| 2007/0277530 | A1* | 12/2007 | Dinu et al. | 60/772 |
| 2008/0155987 | A1* | 7/2008 | Amond et al. | 60/737 |
| 2009/0223225 | A1* | 9/2009 | Kraemer et al. | 60/723 |
| 2009/0255258 | A1* | 10/2009 | Bretz et al. | 60/737 |
| 2009/0277176 | A1* | 11/2009 | Caples | 60/737 |
| 2009/0277182 | A1* | 11/2009 | Engelbrecht | F23D 11/36 60/772 |
| 2010/0077760 | A1* | 4/2010 | Laster et al. | 60/742 |
| 2010/0101229 | A1* | 4/2010 | York et al. | 60/737 |
| 2010/0192591 | A1* | 8/2010 | Eroglu et al. | 60/772 |
| 2010/0205970 | A1* | 8/2010 | Hessler et al. | 60/734 |
| 2012/0296428 | A1* | 11/2012 | Donner | A61F 2/30988 623/17.11 |

FOREIGN PATENT DOCUMENTS

| | | |
|---|---|---|
| EP | 0718561 | 6/1996 |
| EP | 1571396 | 9/2005 |

* cited by examiner

BURNER OF A GAS TURBINE

This application claims priority under 35 U.S.C. §119 to European patent application no. 09160209.4, filed 14 May 2009, the entirety of which is incorporated by reference herein.

BACKGROUND

Field of Endeavor

The present invention relates to a burner of a gas turbine.

Brief Description of the Related Art

In particular the present invention refers to a sequential combustion gas turbine; these gas turbines are known to include a compressor generating a main compressed air flow and feeding it to a first burner.

In the first burner a fuel is injected in the compressed air flow to form a mixture that is combusted and expanded in a high pressure turbine.

The hot gas flow discharged by the high pressure turbine (that still includes a large amount of air) is then fed to a second burner, where further fuel is injected to form a mixture; this mixture is thus combusted and expanded in a low pressure turbine.

A burner embodying principles of the present invention is advantageously the second burner of the sequential combustion gas turbine and is made of a duct (typically with a rectangular, square or trapezoidal shape) housing a conditioning device for guaranteeing a straightened inflow of the hot gas coming from the high pressure turbine.

The duct also has four vortex generators, each extending from one of its walls and arranged to generate vortices within the hot gas flow.

Downstream of the vortex generators, the duct has a lance made of a stem from which a terminal portion extends; the terminal portion is provided with nozzles for injecting the fuel.

The end portion of the duct defines a mixing zone where the fuel injected by the lance mixes with the hot gas flow.

Nevertheless, as the lance is positioned immediately downstream of the vortex generators, its stem at least partially blocks the vortices generated by the upper vortex generator (i.e., the vortex generator projecting from the same wall as the stem of the lance).

This disturbs the structure of the vortices within the burner and, in practice, decreases the total mixing efficiency, causing high $NO_x$ emissions.

In addition, the gas flow (which includes a large amount of air), when passing through the duct, is subjected to a large pressure drop, due in particular to the stem of the lance. This worsens the performance of the gas turbine.

Different burners have been developed which face these drawbacks.

U.S. Pat. No. 5,513,982 discloses a burner having vortex generators that have a tetrahedral shape and are provided with holes or nozzles at their side walls. In a different embodiment of the burner of U.S. Pat. No. 5,513,982, the holes or nozzles are placed along all the width of the side walls.

Nevertheless, in both cases, since the fuel is injected from the vortex generators, it enters recirculating regions with very low axial velocity.

Because of the high temperature of the hot gas flow, it auto ignites within the duct (i.e., before entering the combustion chamber located downstream of the duct), damaging the burner.

SUMMARY

One of numerous aspects of the present invention includes a burner by which problems of the known art are addressed.

Another aspect includes providing a burner by which the vortices are increased and, in particular, the vortices are not disturbed or their propagation is not prevented after their formation.

Another aspect relates to a burner by which pressure drops are smaller than that caused by the traditional burners. This allows better performances of the gas turbines to be achieved.

Yet another aspect includes a burner with a reduced flashback risk, because there is no risk that auto ignition of the fuel occurs within the duct of the burner.

Another aspect includes a lance stem which is integrated with one of the vortex generators.

Advantageously, a burner embodying principles of the present invention allows the $NO_x$ emission to be reduced relative to traditional burners.

BRIEF DESCRIPTION OF THE DRAWINGS

Further characteristics and advantages of the invention will be more apparent from the description of a preferred, but non-exclusive, embodiment of the burner according to the invention, illustrated by way of non-limiting example in the accompanying drawings, in which.

DETAILED DESCRIPTION OF EXEMPLARY EMBODIMENTS

With reference to the figures, a burner of a gas turbine is illustrated, overall indicated by the reference 1.

In particular the burner can be the second burner of a sequential combustion gas turbine.

Figure 3:
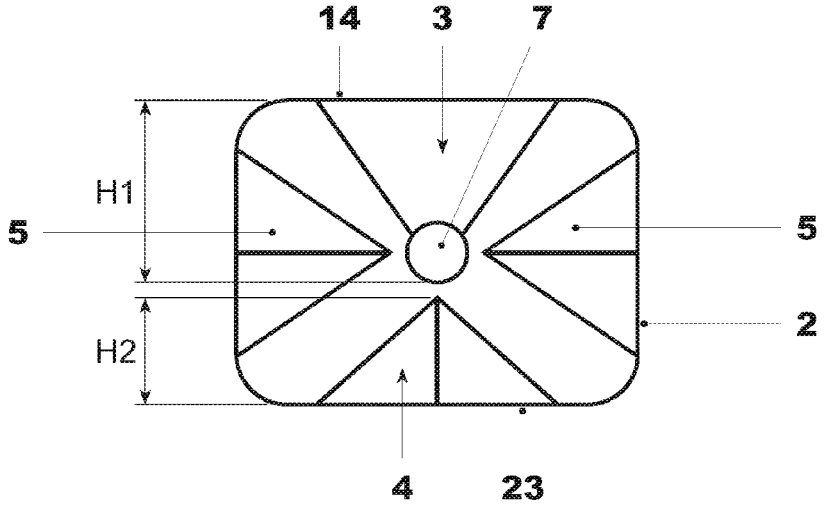
FIG. 3 is a front view from the outlet of the burner according to the invention.
Figure 4:
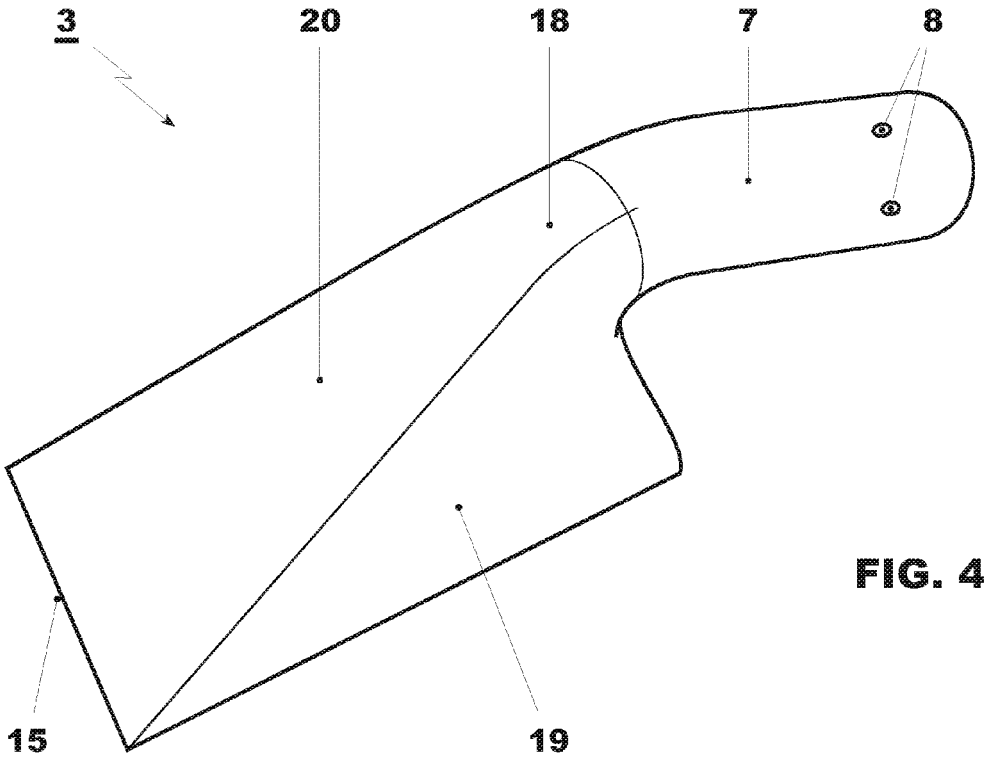
FIGS. 4 and 5 are two perspective views of the vortex generator integrated with the lance of the burner of the invention.

The burner 1 includes a duct 2 with a rectangular or square or trapezoidal or annular sector shape (in FIG. 3, a rectangular shape is shown).

The duct 2 houses four vortex generators projecting from each of its walls.

A first vortex generator 3 projects from the upper wall of the duct, a second vortex generator 4 projects from the bottom wall of the duct, and two side vortex generators 5 project from the side walls of the duct.

The burner is also provided with a lance 7 which extends from the first vortex generator 3.

The lance 7 carries one or more nozzles 8 for injecting a fuel within the duct 2; in the present embodiment, the lance carries four nozzles that are placed two at one side and the other two at the other side of the lance. It is anyhow clear that the nozzles 8 may also be different in number and may be placed differently on the lance 7.

Advantageously, the nozzles each have their axis perpendicular to an axis 11 of the duct 2, in order to make the fuel distribute in the volume of the duct after injection.

The nozzles 8 are arranged to inject both liquid and gaseous fuel and, in this respect, they are provided with a plurality of coaxial apertures.

A central aperture is arranged to inject a liquid fuel and a first annular aperture encircling the central aperture is arranged to inject a gaseous fuel.

A further annular aperture of the nozzles encircling both the central and the first annular aperture is arranged to inject a shielding air flow.

The lance 7 has a substantially cylindrical body with a longitudinal axis 10 which is substantially parallel to the longitudinal axis 11 of the duct 2.

Preferably, the axis 10 of the lance 7 overlaps the axis 11 of the duct 2 and the lance 7 is made in one piece with the first vortex generator 3.

Moreover, the lance 7 protrudes from the first vortex generator 3 towards an outlet 13 of the duct 2.

The first vortex generator 3 has a substantially tetrahedral shape with a base surface 14 overlapping the wall of the duct 2.

In addition, the first vortex generator 3 has a leading edge 15 perpendicular to the axis 11 of the duct 2 and laying on the wall of the duct 2.

Figure 1:
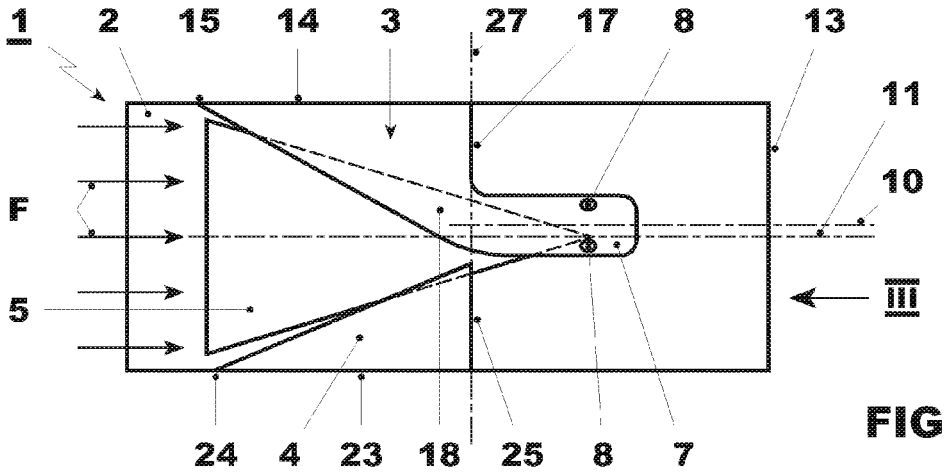
FIG. 1 is a schematic longitudinal cross section of a burner according to the invention, in which the side vortex generator in front of the upper and bottom vortex generators is not shown.
Figure 2:
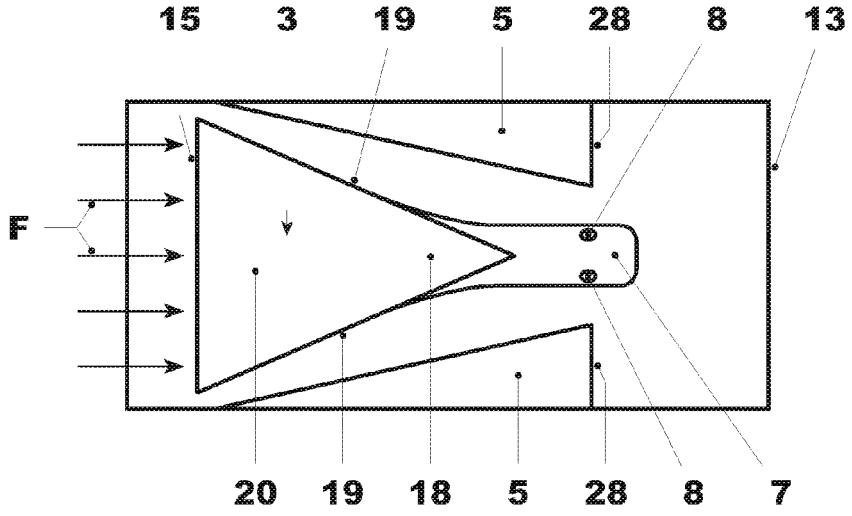
FIG. 2 is a schematic transverse cross section of the burner according to the invention, in which the bottom vortex generator is not shown.

The vortex generator 3 also has a trailing edge 17 perpendicular to the axis 11 of the duct 2 and perpendicular to the wall of the duct 2 (FIG. 1).

Figure 5:
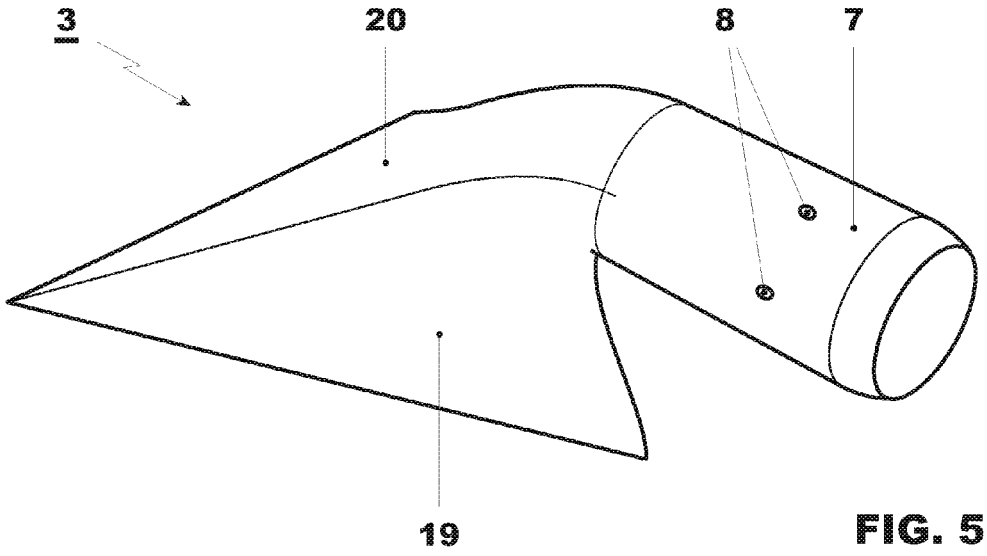
Figure 6:
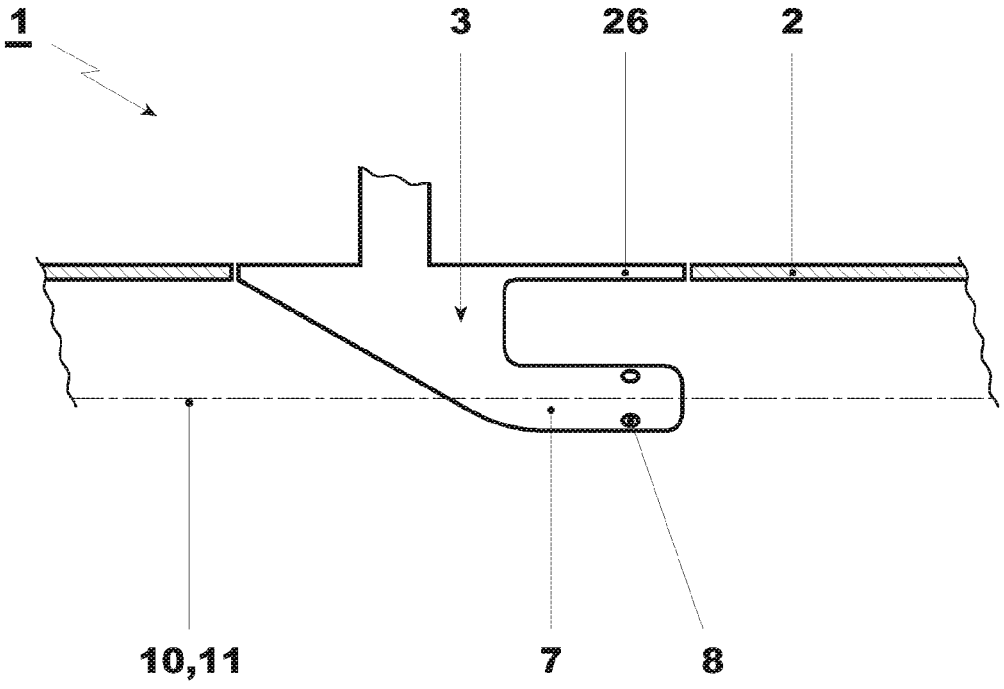
FIG. 6 is a schematic partial cross section of a duct with a vortex generator of a burner according to the invention.

In a different embodiment the trailing edge 17 of the vortex generator 3 is neither perpendicular to the axis 11, nor to the wall of the duct 2 (FIG. 5).

The lance 7 extends from a zone 18 of the first vortex generator 3 where two side surfaces 19 and a top surface 20 converge.

As shown in the figures, the first vortex generator 3 faces the second vortex generator 4.

In a transversal plane (see FIG. 3), the total height H1 of the first vortex generator 3 and the lance 7 is greater than the height H2 of the second vortex generator 4.

The second vortex generator 4 is similar to the first vortex generator 3 and, in this respect, it also has a tetrahedral shape, with a base surface 23 overlapping a wall of the duct 2, a leading edge 24 perpendicular to the axis 11 of the duct 2 and laying on the wall of the duct 2, and a trailing edge 25 perpendicular to the axis 11 of the duct 2 and also perpendicular to the wall of the duct 2.

The trailing edge 17 of the first vortex generator 3 and the trailing edge 25 of the second vortex generator 4 both lay in a transversal plane 27 perpendicular to the axis 11.

Moreover, the two side vortex generators 5 that project from the side walls of the duct 2 also have a tetrahedral shape with a trailing edge 28 substantially perpendicular to the wall of the duct and placed downstream of the trailing edges 17, 25 of the first and second vortex generators 3, 4.

The burner 1 includes a device for removably connecting the first vortex generator 3 within the duct 2; advantageously this allows an increased flexibility for aerodynamic optimization of the flow pattern in the upper/lower part of the burner, since the vortex generator with the lance protruding from it is fully retractable.

In particular, the first vortex generator 3 has a plate 26, preferably made in one piece with it, that extends in the same direction as the lance 7 and is arranged to close a hole of the duct 2 through which the vortex generator 3/lance 7 are introduced within the duct 2.

The plate 26 stretches to completely cover the lance 7.

The working principle of the burner of the invention is apparent from that described and illustrated and is substantially as follows.

The hot gas flow F coming from the high pressure turbine enters the duct 2 and passes through the vortex generators 3, 4, 5, increasing its vorticity.

Afterwards, the hot gas flow F passes around the lance 7 where the fuel is injected from the nozzles 8.

As the lance 7 projects from the vortex generator 3 and the nozzles 8 are close to the tip of the lance 7 (thus the nozzles 8 are far away from the trailing edge 17 of the vortex generator 3), the fuel is injected in a zone of the duct 2 where the vortices are completely formed, with no risk that the fuel will be withheld within a core of the vortices.

In addition, the vortices are more uniform and stronger than with traditional burners, because their propagation has not been disturbed by the stem of the lance.

Moreover, as the fuel is injected perpendicularly to the wall of the duct 2 (i.e., it is injected in the injection plane which is perpendicular to both the axis of the lance 10 and the axis of the duct 11) it spreads over the entire volume of the duct.

This permits a good distribution of the fuel within the hot gas flow to be achieved and, thus, an optimal mixing quality be obtained; the increased mixing quality lets the emissions be improved and in particular the $NO_x$ emission be reduced.

In addition, as in traditional burners, the stem of the lance causes a large pressure drop in the hot gas flow passing through the duct, a burner embodying principles of the present invention allows the pressure drop to be reduced and the performances of the gas turbine to be increased.

In practice the materials used and the dimensions can be chosen at will according to requirements and to the state of the art.

REFERENCE NUMBERS

1 burner
2 duct
3 first vortex generator
4 second vortex generator
5 side vortex generators
7 lance
8 nozzles
10 longitudinal axis of the lance
11 axis of the duct
13 outlet of the duct
14 surface of the first vortex generator
15 leading edge of the first vortex generator
17 trailing edge of the first vortex generator
18 zone of the first vortex generator
19 side surfaces of the first vortex generator
20 top surface of the first vortex generator
23 base surface of the second vortex generator
24 leading edge of the second vortex generator
25 trailing edge of the second vortex generator
26 plate
27 transversal plane perpendicular to axis 11
28 trailing edges of the side vortex generators
H1 total height of the first vortex generator
H2 height of the second vortex generator
F gas flow While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A burner of a gas turbine, the burner comprising:

a duct having a duct wall, the duct wall including and housing a first vortex generator projecting from the duct wall and a lance having at least a nozzle configured and arranged to inject a fuel within the duct;

wherein said lance has a substantially cylindrical body with a longitudinal axis extending parallel to a longitudinal axis of the duct, and wherein the lance extends from a trailing edge of the first vortex generator towards an outlet of the duct;

wherein the lance and the first vortex generator are a single piece;

wherein the first vortex generator is a separate element from the duct;

wherein the first vortex generator faces at least a second vortex generator, and wherein in a transverse plane, a height of the first vortex generator without the lance is greater than a height of the second vortex generator;

wherein the trailing edge of the first vortex generator and the trailing edge of the second vortex generator lay in the transverse plane perpendicular of the longitudinal axis of the duct; and two side vortex generators, each of the two side vortex generators having a trailing edge perpendicular to the wall of the duct, and wherein the trailing edges of the two side vortex generators are downstream of the trailing edges of the first and second vortex generators.

2. The burner as claimed in claim 1, wherein the lance protrudes from the first vortex generator towards the duct outlet.

3. The burner as claimed in claim 1, wherein the first vortex generator has a substantially tetrahedral shape.

4. The burner as claimed in claim 3, wherein the first vortex generator has a leading edge perpendicular to the longitudinal axis of the duct and laying on the duct wall.

5. The burner as claimed in claim 4, wherein the trailing edge of the first vortex generator is perpendicular to the longitudinal axis of the duct and also perpendicular to the duct wall.

6. The burner as claimed in claim 3, wherein the first vortex generator comprises two side surfaces and a top surface which converge at a zone; and the lance extends from said zone.

7. The burner as claimed in claim 1, wherein:

the second vortex generator has a tetrahedral shape, including a base surface overlapping the duct wall, and a leading edge perpendicular to the duct axis and laying on the duct wall.

8. The burner as claimed in claim 1, wherein the first vortex generator is removably connected within the duct.

9. The burner as claimed in claim 8, wherein the duct includes a hole configured to introduce the first vortex generator into the duct; and the first vortex generator comprises a plate in one piece with the first vortex generator, the plate extending in the same direction as the lance and closing the duct hole.

10. The burner as claimed in claim 1, wherein the first vortex generator is configured to extend to the longitudinal axis of the duct.

11. The burner as claimed in claim 10, wherein the second vortex generator does not extend to the longitudinal axis of the duct.

12. The burner as claimed in claim 1, wherein each of the first, second, and two side vortex generators have a substantially tetrahedral shape with a base surface overlapping the duct wall.

13. A burner of a gas turbine, the burner comprising:

a duct having a duct wall, the duct wall including and housing a first vortex generator projecting from the duct wall; and a lance having at least a nozzle configured and arranged to inject a fuel within the duct, wherein said lance has a substantially cylindrical body with a longitudinal axis extending parallel to a longitudinal axis of the duct, and wherein the lance extends from a trailing edge of the first vortex generator towards an outlet of the duct;

wherein the first vortex generator faces at least a second vortex generator, and wherein in a transverse plane, a height of the first vortex generator without the lance is greater than a height of the second vortex generator, and the trailing edge of the first vortex generator and a trailing edge of the second vortex generator lay in the transverse plane perpendicular of the longitudinal axis of the duct; and two side vortex generators, each of the two side vortex generators having a trailing edge perpendicular to the wall of the duct, and wherein the trailing edges of the two side vortex generators are downstream of the trailing edges of the first and second vortex generators.

14. The burner as claimed in claim 13, wherein:

the lance and the first vortex generator are a single piece.

15. The burner as claimed in claim 13, wherein each of the first, second, and two side vortex generators have a substantially tetrahedral shape with a base surface overlapping the duct wall.

16. A burner of a gas turbine, the burner comprising:

a rectangular duct having a duct wall, the duct wall including and housing a first vortex generator projecting from the duct wall and a lance having at least a nozzle configured and arranged to inject a fuel within the duct;

wherein said lance has a substantially cylindrical body with a longitudinal axis extending parallel to a longitudinal axis of the duct, and wherein the lance extends from a trailing edge of the first vortex generator towards an outlet of the duct;

wherein the lance and the first vortex generator are a single piece;

wherein the first vortex generator is a separate element from the duct;

the trailing edge of the first vortex generator and a trailing edge of a second vortex generator lay in the transverse plane perpendicular of the longitudinal axis of the duct; and two side vortex generators, each of the two side vortex generators having a trailing edge perpendicular to the wall of the duct, and wherein the trailing edges of the two side vortex generators are downstream of the trailing edges of the first and second vortex generators.

17. The burner as claimed in claim 13, wherein the second vortex generator has a tetrahedral shape, including a base surface overlapping the duct wall, and a leading edge perpendicular to the duct axis and laying on the duct wall.

18. The burner as claimed in claim 13, wherein the first vortex generator has a substantially tetrahedral shape and a leading edge perpendicular to the longitudinal axis of the duct and laying on the duct wall.

19. The burner as claimed in claim 16, wherein the second vortex generator has a tetrahedral shape, the second vortex generator including a base surface overlapping the duct wall and a leading edge perpendicular to the duct axis and laying on the duct wall.

* * * * *